United States Patent [19]

Sugimoto

[11] Patent Number: 5,005,267

[45] Date of Patent: Apr. 9, 1991

[54] BUCKLE ASSEMBLY FOR SEAT BELT

[75] Inventor: Mutsumi Sugimoto, Hamamatsu, Japan

[73] Assignee: Katsuyama Kinzoku Kogyo Kabushiki Kaisha, Japan

[21] Appl. No.: 413,539

[22] Filed: Sep. 27, 1989

[30] Foreign Application Priority Data

Sep. 28, 1988 [JP] Japan ..... 63-243795
Aug. 25, 1989 [JP] Japan ..... 1-217504

[51] Int. Cl.[5] ..... A44B 11/26
[52] U.S. Cl. ..... 24/637; 24/633
[58] Field of Search ..... 24/637, 636, 638, 633, 24/641, 651

[56] References Cited

U.S. PATENT DOCUMENTS

| | | | |
|---|---|---|---|
| 4,391,023 | 7/1983 | Tanaka et al. | 24/633 |
| 4,575,908 | 3/1986 | Gloomis et al. | 24/637 |
| 4,587,696 | 5/1986 | Ueda et al. | 24/637 |
| 4,597,141 | 7/1986 | Wier | 24/633 |
| 4,624,034 | 11/1986 | Ishiguro et al. | 24/636 |
| 4,733,443 | 5/1988 | Tolfsen | 24/637 |

*Primary Examiner*—Victor N. Sakran

*Attorney, Agent, or Firm*—Bruce L. Adams; Van C. Wilks

[57] ABSTRACT

A buckle assembly for a seat belt generally comprises a base having a horizontal plate and side plates, a latch means to be engaged with the side plates and supported thereby so as to be swingable between a latch locking position and a latch releasing position, a push button pivotally mounted to the side plates, a spring means to be engaged with the latch means so as to always urge the latch means towards the locking position thereof, and a tongue means to be inserted into a tongue insertion space formed between the horizontal plate and the side plates of the base and engaged with the latch means. The spring means is of a double tortional spring structure comprising double tortional portions, a central lock spring portion formed between the double tortional portions and adapted to urge the latch means to the locking position thereof, and cantilever portions formed outside the double tortional portions and adapted to be supported by the push button so as to urge the push button towards an original position thereof. The latch means is provided with an improved guide means for smoothly and safely inserting the tongue means into the tongue insertion space of the base.

22 Claims, 12 Drawing Sheets

BUCKLE ASSEMBLY FOR SEAT BELT

BACKGROUND OF THE INVENTION

This invention relates to a buckle assembly for a seat belt used as a safety belt provided for a motor vehicle or aircraft and, more particularly, a buckle assembly for a push button type seat belt.

Buckles of this type commonly used have been disclosed in Japanese Patent Laid-Open Publication Nos. 60-18102, 60-75004 and 60-75005. In this type of buckle, locking is effected when a latch engages a latch engaging bore formed on its tongue by inserting the tongue into a buckle body, whereby withdrawal of the tongue is prevented.

Further, in this type of seat belt buckle, the tongue is at first inserted fully into the buckle body, so that, after locking is effected, the latch engagement of the tongue cannot be released and the locking position is securely maintained even if a shock has been applied to the buckle, and furthermore a push button for removing the latch engagement may be pressed by applying only a slight pressure. After the locking is released by pressing the push button, the tongue that is now freed from the latch engagement may be pulled out from the buckle body.

Spring components of complicated shapes are held in the buckle body of a conventional seat belt buckle in order to bring the push button back to its original position, as well as to push (press) the latch continuously toward its locked position.

Since, however, the spring components in the conventional seat belt buckles are formed into complicated spring shape, controlling of the spring components has been difficult, hindering the automated assembling of the belt buckle.

There is also a type, such as indicated in Japanese Utility Model Laid-Open Publication No. 61-194311, in which a double torsional coiled spring is used as the spring component incorporated into a seat belt buckle, for pressing the push button to bring it back toward its original position as well as for pushing the latch toward its locked position using this coiled spring.

Because, in the conventional seat belt buckle using a double torsional coiled spring, the latch is pressed by engaging each free end of the cantilever of the coiled spring with the latch, it is difficult to let the spring force of the coiled spring act on the latch in a well balanced manner, and because each movable end of the coiled spring is individually engaged with the latch and its position is determined after the double torsional part of the coiled spring has been inserted into a retaining pin to be retained, assembling of the double torsional coiled spring is difficult, hindering the automatic assembling of the seat belt buckle.

Moreover, the seat belt buckle described in Utility Model Laid-Open Publication No. 61-194311 is with a risk such that, when the cover is removed, the push button may be also removed from the retaining groove of the base body, if being shocked for some reason, that is, a seat belt buckle with the push button released does not function as a buckle.

SUMMARY OF THE INVENTION

An object of this invention is to substantially eliminate the defects or drawbacks encountered in the prior art and to provide a buckle assembly for a seat belt incorporating a spring component having a simplified structure and being capable of applying the spring force to a latch for locking the seat belt buckle in a well balanced manner.

Another object of this invention is provide a seat belt buckle which is less in number of components, has simpler internal structure, and is easier in assembling, and which is improved in operability by making possible the easy engagement and release of the latch of the tongue by means of a push button operation.

A further object of this invention is to provide a seat belt buckle capable of sufficiently maintaining the function as a buckle even when the base body is removed from the cover in response to an unspecified impact.

These and other objects can be achieved according to this invention by providing a buckle assembly for a seat belt which comprises a base having a horizontal plate and side plates formed integrally with both longitudinal side portions of the horizontal plate and extending substantially normal thereto, a latch means to be engaged with the side plates and supported thereby so as to be swingable between a latch locking position and a latch releasing position, a push button pivotally mounted to the side plates of the base, a spring means engaged with the latch means so as to always urge the latch means towards the locking position thereof, the spring means having a double torsional spring structure comprising double torsional portions, a central lock spring portion formed between the double torsional portions and adapted to urge the latch means to the locking position thereof, and cantilever portions formed outside the double torsional portions and adapted to be supported by the push button so as to urge the push button towards an original position thereof, a tongue means to be inserted into a tongue insertion space formed between the horizontal plate and the side plates of the base and engaged with the latch means, a lower cover for covering the base from a lower side thereof, and an upper cover for covering the base from an upper side thereof and engaged with the lower cover when a backle for a seat belt is assembled.

In preferred embodiments of this invention, the side plates are provided with supporting holes and the latch means is provided with ear-like portions which are engageable with the supporting holes of the side plates when the latch means is inserted to be swingable between the locking position and releasing position thereof.

The push button is provided at a base end thereof with an ear-like shaft which is engageable at both ends thereof with the side plates to be pivotable thereabout.

The double torsional spring means is in form of bilaterally symmetrical structure and the double torsional portions of the spring means are in form of coiled spring elements.

The base is provided with a push out mechanism engageable with a front end of the tongue means, the push out mechanism acting so as to push out the tongue means when said latch means is released by downwardly pressing the push button.

The push button is provided with side portions on which projections extending outwardly are formed and the side plates of the base are provided with projections extending inwardly, the outward projections of the push button and the inward projections of the side plates constituting a stopper mechanism for the push button when engaged with each other.

The latch means comprises a flat base portion and a balance weight portion integrally formed with the flat base portion so as to exhibit a dog leg shape, the flat base portion being provided with a central portion recessed to constitute a latch nail to be engaged with the spring means and with ear-like side portions so that a central line between the ear-like portions as being an axial line for a swinging motion of the latch means passes a center of gravity of the latch means.

The flat base portion of the latch means is further provided with a guide bellows extending outwardly at substantially a central portion of the latch nail for guiding an insertion of the central lock spring portion of the spring means and with a pair of spring guides disposed so as to extend over the latch nail and adapted to support the insertion of the lock spring portion of the spring means.

The tongue means is inseparably provided with a resilient member for preventing a jolting motion thereof when inserted into the tongue inserting space.

According to the seat belt buckle assembly of the character described above, the double torsional spring is employed as the spring component held in the main body of the buckle, making each free end of the double torsional spring to be supported by the push button so that the lock spring portion thereof may engage a latch, so that it is possible to let the spring force of the double torsional spring act steadily and smoothly on the latch, and assembling of the double torsional spring is easier, i.e., making possible the automated assembling, as it only takes to engage the central locking spring portion with the latch after having the double torsional spring supported by the push button.

The spring structure may be simplified, because the double torsional spring is used as the spring component and the number of the components is less. The internal structure may also be simplified, because th double torsional spring performs both the function to push the latch toward the lock position and the function to press the push button toward the original position.

Also since the seat belt buckle assembly is provided with inward projections on the side of the base body which engage the side projections of the push button to form a stopper structure to thereby maintain the function as a buckle and the safety condition even if the cover is removed as a result of unspecified impact.

These and other preferred embodiments will be further made clear hereunder with reference to the accompanying drawings.

DESCRIPTION OF THE PREFERRED EMBODIMENTS

A seat belt buckle embodying this invention will now be described with reference to the accompanying drawings.

Figure 1:
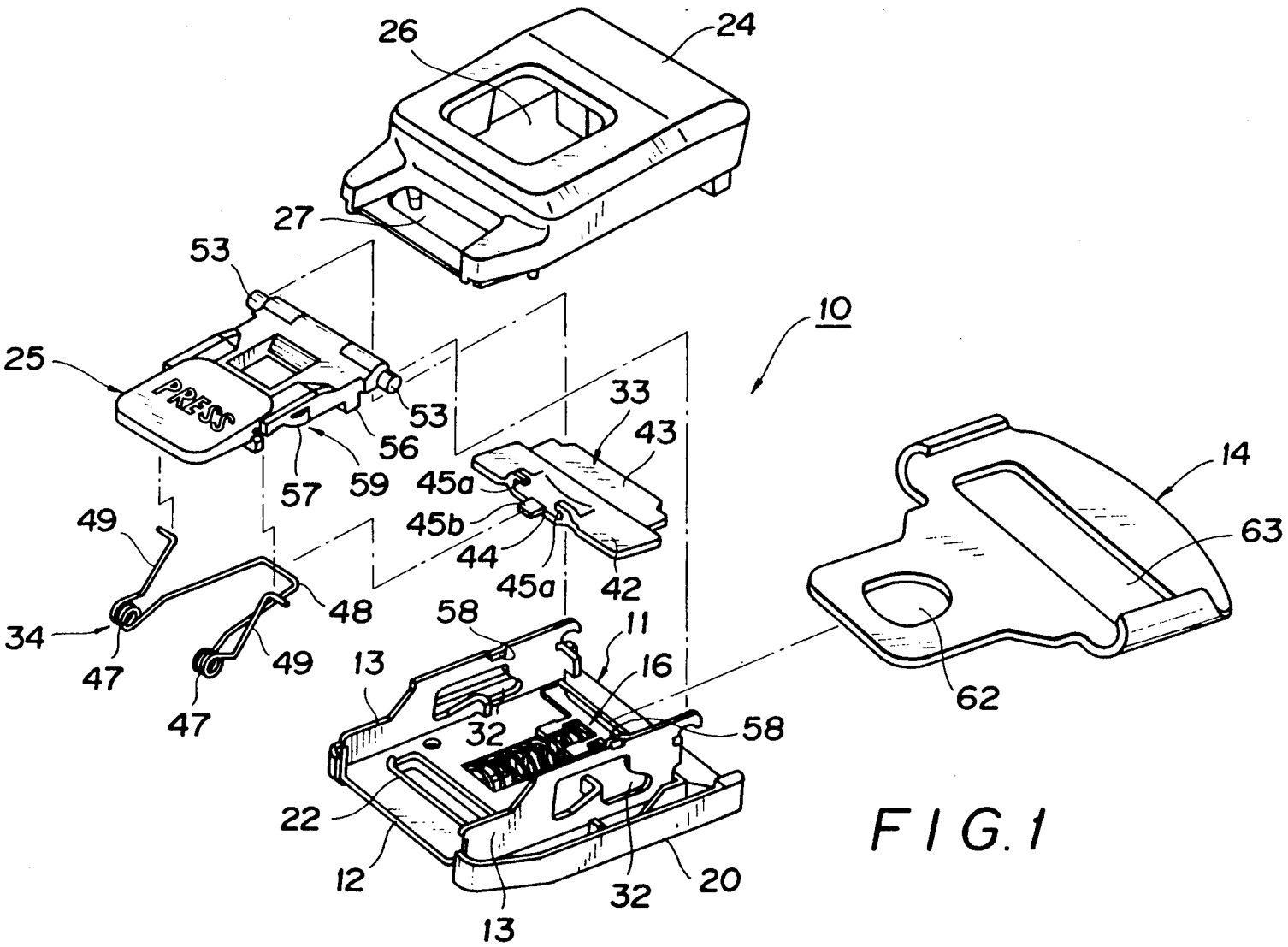
FIG. 1 is an exploded overall perspective view showing one embodiment of a seat belt buckle assembly according to this invention.

Referring to FIG. 1, which is an overall perspective view of the seat belt according to this invention, a main buckle body of a buckle for a push button style seat belt is generally designated by reference numeral 10. The buckle body 10 has a base 11, which is provided on the central portion thereof with a horizontal plate 12 in the form of a plate, while both sides of the horizontal plate 12 are raised in a generally perpendicular direction to form the side plates 13.

Figure 2:
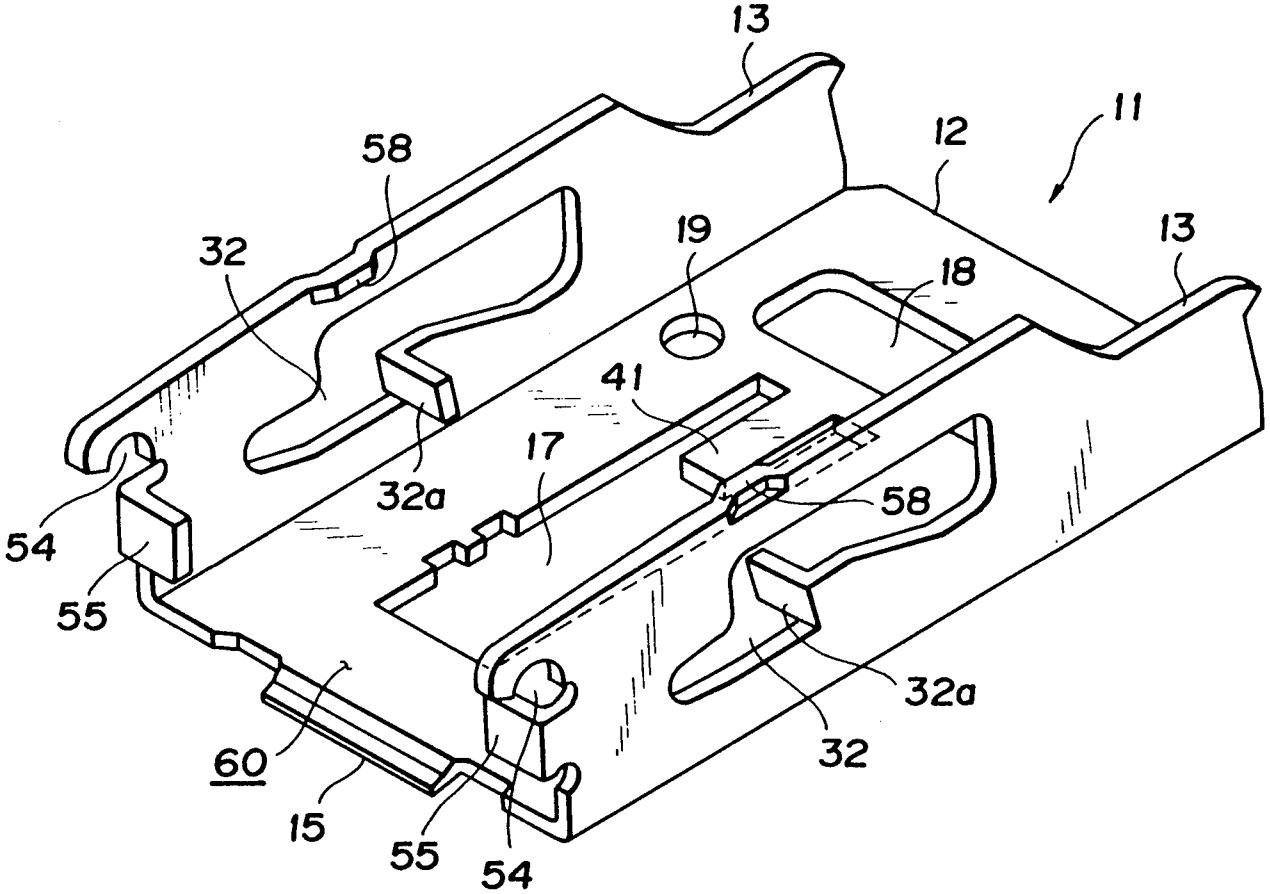
FIG. 2 is a perspective view showing a base which is to be incorporated in the buckle assembly to constitute a part of the seat belt buckle assembly shown in FIG. 1.

The horizontal plate 12 of the base 11 is formed into a guide path for guiding the tongue 14, and is provided in its front end with an engaging projection 15 that protrudes diagonally downward in a shape of bellows as shown in FIG. 2, and a slide guide bore 17 in the central portion for a push out structure 16, and a webbing bore 18 for guiding seat belt webbing (not shown) and a stabilizer pin hole 19 are respectively formed at the rear portion of the plate 12.

Figure 3A:
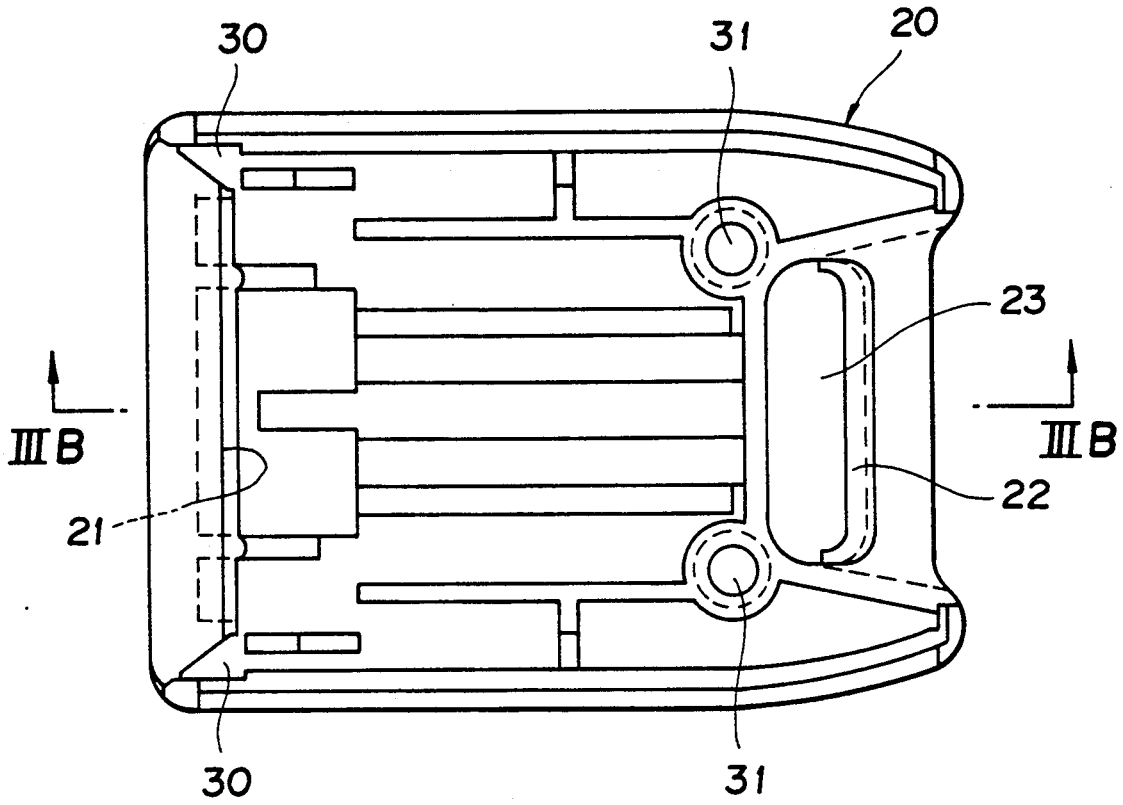
FIG. 3A a plan view showing an under cover which covers the main buckle body of the seat belt buckle assembly.
Figure 3B:
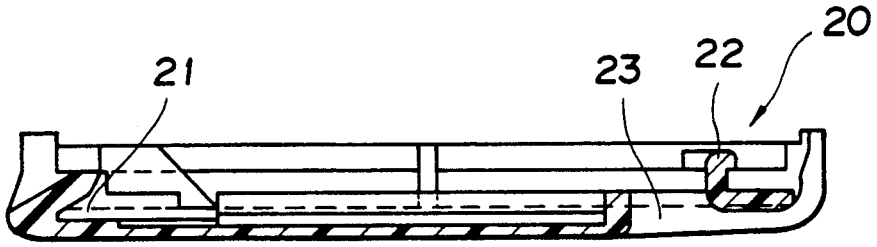
FIG. 3B is a cross section taken along the line III-B—IIIB of FIG. 3A.
Figure 4A:
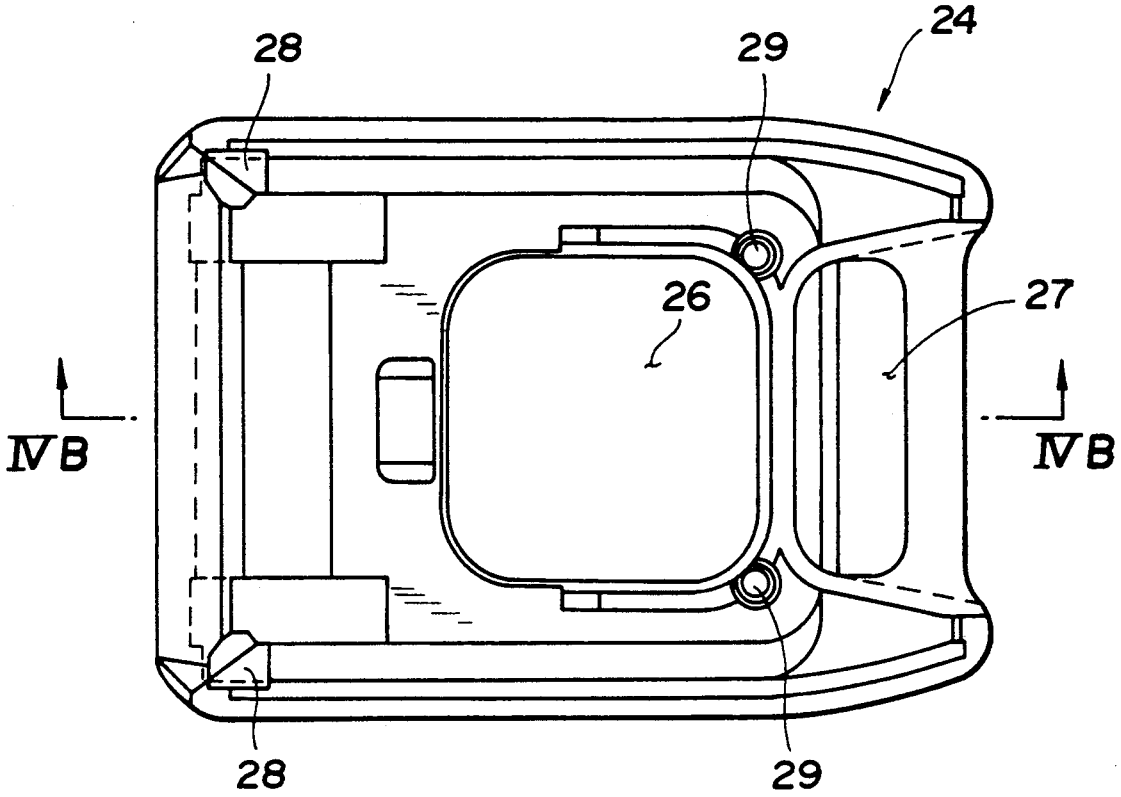
FIG. 4A is a bottom plan view showing upper cover of the seat belt buckle.
Figure 4B:
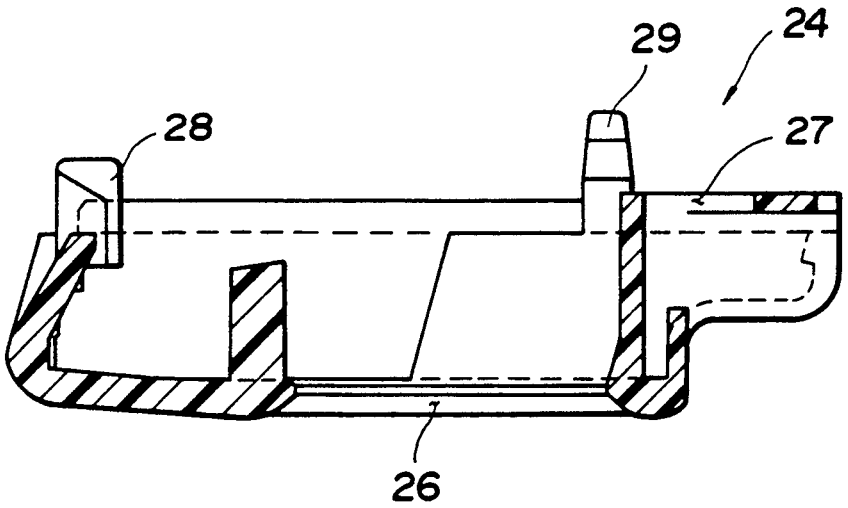
FIG. 4B is a cross section taken along the line IV-B—IVB of FIG. 4A.

An under cover 20 as shown in FIGS. 3A and 3B is mounted to the base 11 from the lower side thereof. The under cover 20 is stabilized when an engaging groove 21 formed in the front end and an engaging upward projection 22 formed in the rear portion respectively engage the engaging projection 15 of the base horizontal plate and the webbing bore 18. A webbing guide bore 23 is formed in the front of the upward engaging projection 22 correspondingly to the webbing bore 18. An upper cover 24 as shown in FIGS. 4A and 4B may be attached to the under cover 22.

An operation aperture 26 for the operation of a push button 25 is formed in the central portion of the upper cover 24, while a webbing guide bore 27 is formed in the rear portion thereof. The guide bore 27 corresponds to the webbing bore 18 and the guide bore 23 that are formed respectively on the base 11 and the under cover 20. Also, in the upper cover 24, position setting projections 28 and pins 29, both in pairs, are inseparably formed. The position setting projections 28 engage receiving grooves 30 of the under cover 20 when the upper cover 24 is mounted to the under cover 20, and the position setting pins 29 engage pin receiving holes 31 of the under cover 20 through position setting pin bores 19 of the base 11, so that the buckle body 10 may be held inside the covers 22 and 24 with position being set.

On the side plates 13 of the base 11, a pair of support bores 32 facing one another are opened in the intermediate portion, and a plate-like latch 33 that will be described later is inserted and supported in the support bore. The inserted latch 33 will be positioned by an inward projection 32*a*, so that the backward movement of the latch 33 is restricted, while being swingable in the support bores 32 between the tongue releasing position and the locking position.

On the other hand, the main buckle body 10 is constituted by assembling the base 11, the push out mechanism 16 provided on the base 11, the latch 33 to lock the tongue 14 that has been inserted into the base 11, a double torsional coiled spring 34 as the spring component for urging the latch 33 by means of spring toward the lock position and the push button 25 that is pivotally supported by the side plates 13 of the base 11.

Figure 5:
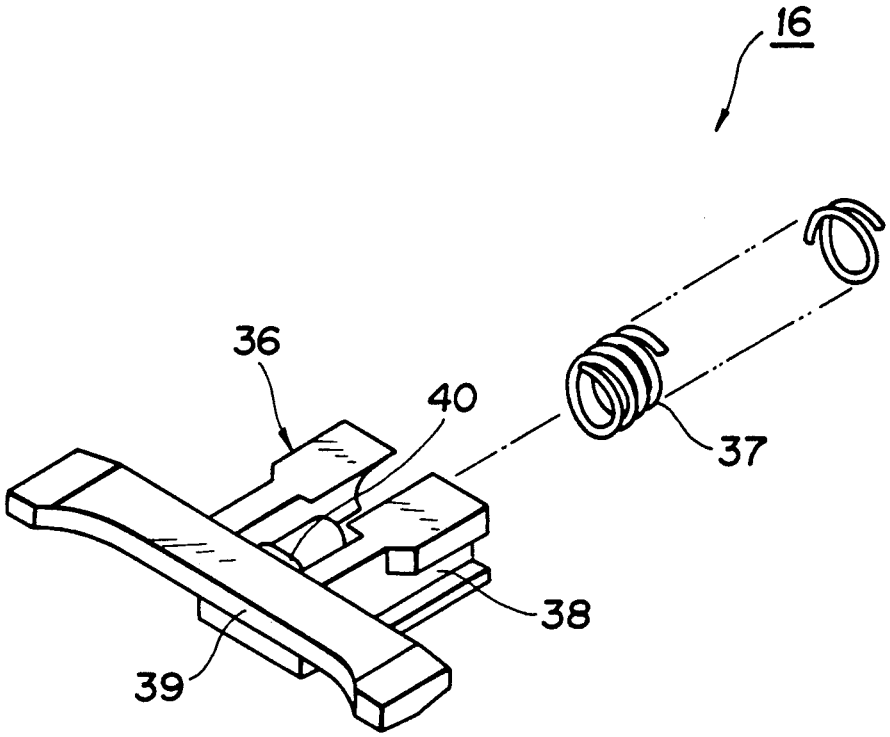
FIG. 5 is an exploded perspective view of a push out structure which constitutes a part of the buckle assembly shown in FIG. 1.

As shown in FIG. 5, the push out mechanism 16 includes a push out slider 36 and a spring 37 that urges frontward the slider 36. The push out slider 36 includes a slide groove 38 that is guided for sliding in the longitudinal direction by engaging a slide guide bore 17 formed on the base horizontal plate 12, a push surface 39 capable of engaging one end of the tongue 14, and a spring receiver 40 to receive the spring 37, and the spring 37 expands and contracts by a spring guide 41 formed on the slide guide bore 17 of the base 11.

Figure 6:
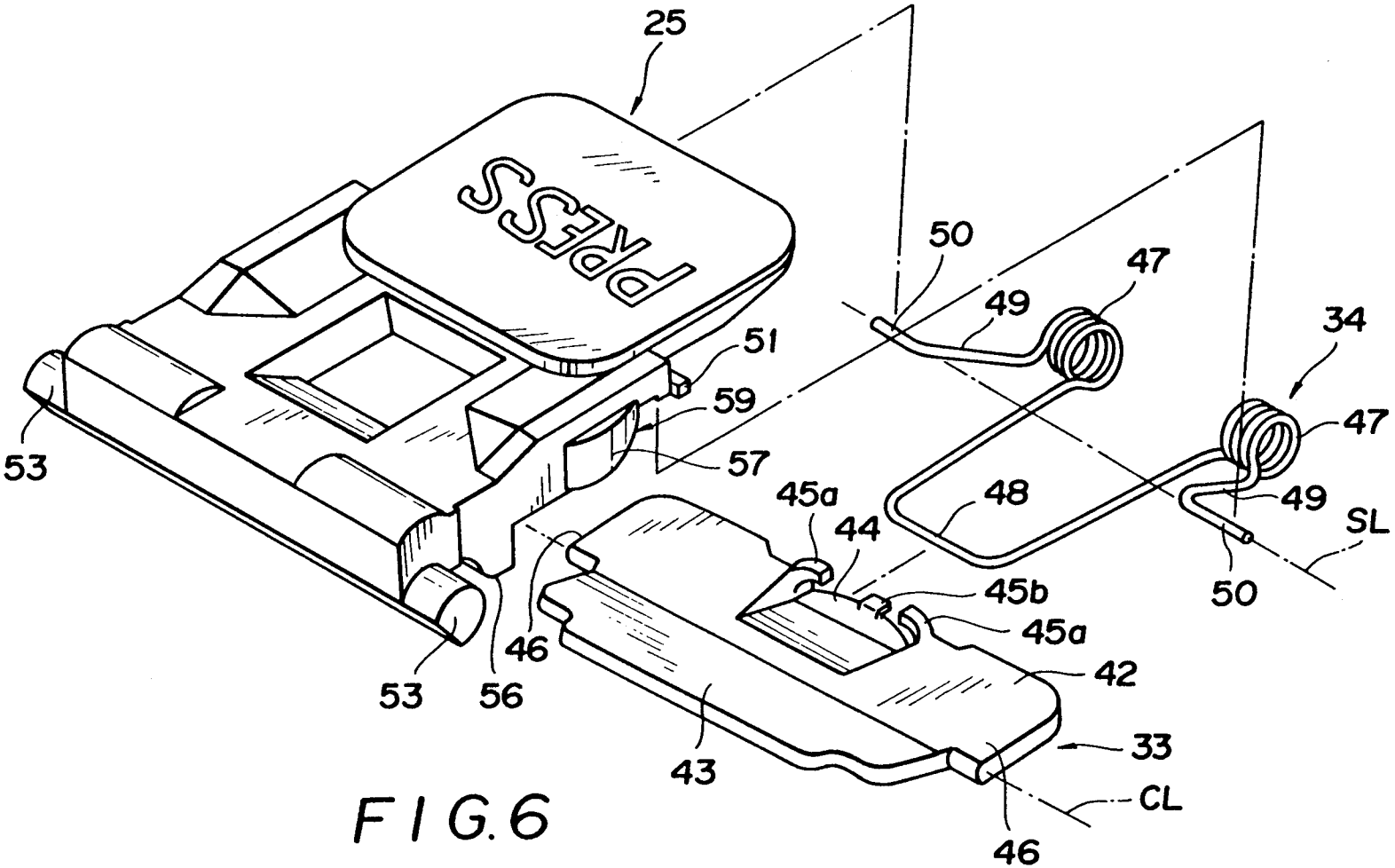
FIG. 6 is a perspective view showing the relation among the push button, the spring component, and the latch all of which are also incorporated into the buckle assembly.
Figure 7A:
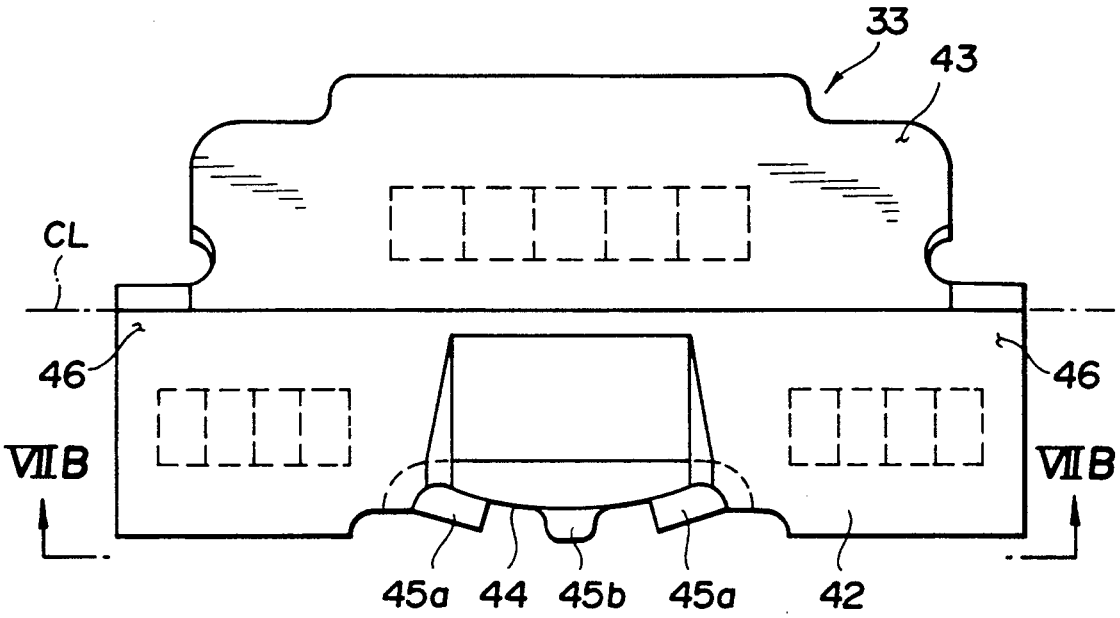
FIG. 7A is a plan views of the latch to be incorporated in the buckle assembly.
Figure 7B:
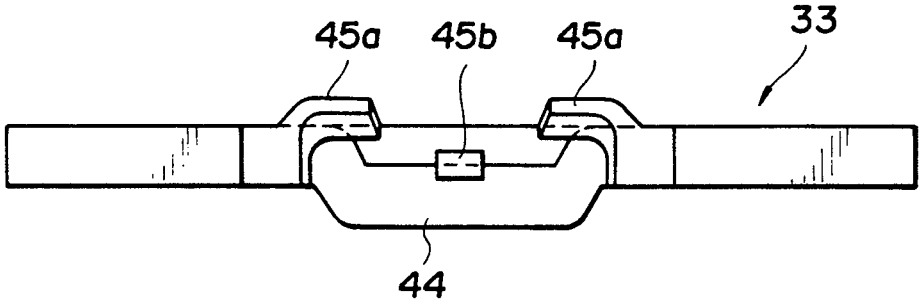
FIG. 7B is a sectional view taken along the line VIIB—VIIB shown in FIG. 7A.
Figure 7C:
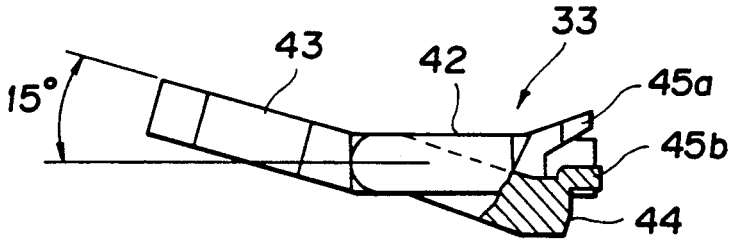
FIG. 7C is a side view, partially broken away, of the latch shown in FIG. 7A.
Figure 8A:
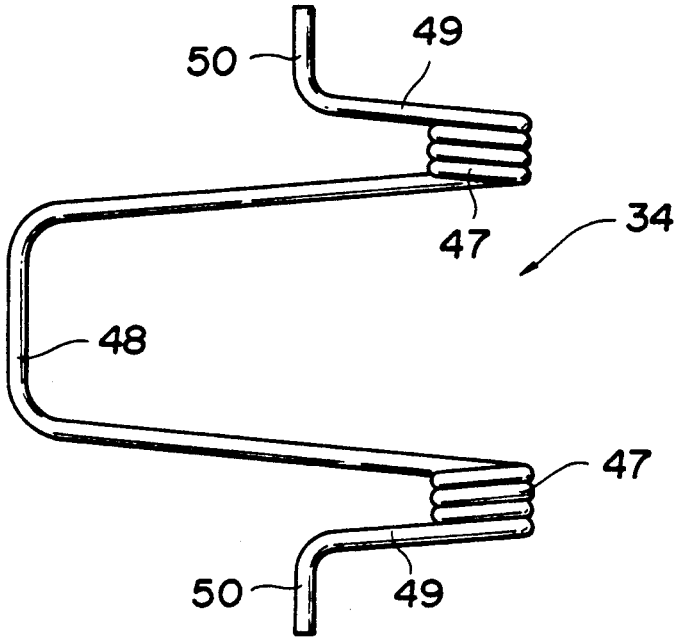
FIGS. 8A and 8B are detailed views of the double torsional coiled spring.
Figure 8B:
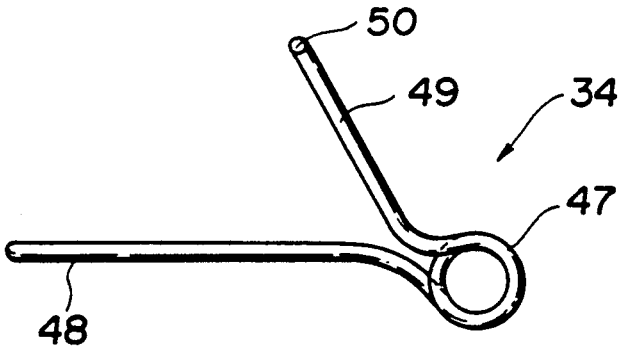
Figure 9A:
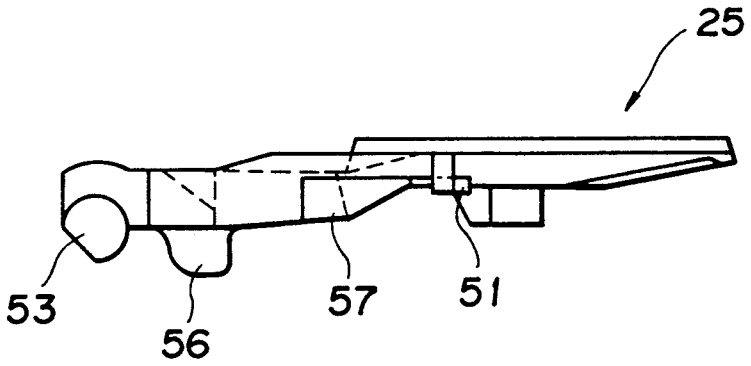
FIGS. 9A and 9B are respectively a side view and a bottom plan view of the push button.
Figure 9B:
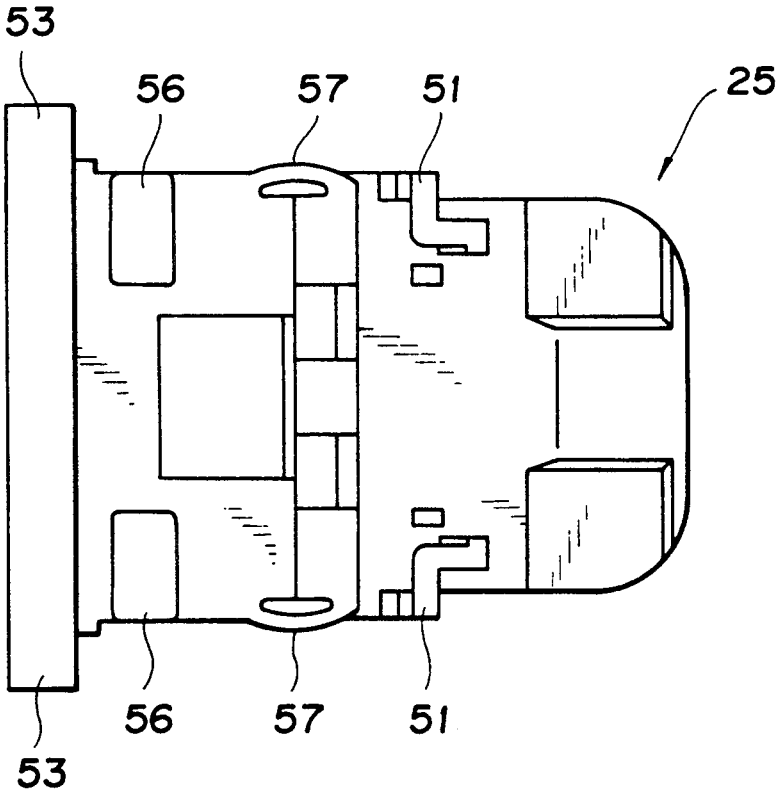

As shown in FIGS. 1 and 6, the latch 33 is constituted by forming a base plate portion 42 and a balance weight portion 43 inseparably into a generaly dog-legged shape, and the central portion of the base plate 42 is formed into a concave that protrudes downward, the concave being constructed as a latch nail 44. A pair of spring guides 45*a* which guide the double torsional coiled spring 34 are angularly formed in a protruding manner on both the sides of the concave and a guide bellows 45*b* is formed so as to guide the insertion of the double torsional spring 34 into the spring engaging portion formed on the upper portion of the concave. The guide bellows 45*b* projects rearwardly from the upper end portion of the latch nail 44 so as to prevent the double torsional coiled spring 34 from disengaging from the spring engaging portion after the double torsional coiled spring 34 has been engaged with the spring engaging portion of the latch nail 44. An ear-like portion 46 is integrally formed on each side end of the main plate portion 42 so that the ear-like portion 46 may be inserted into the support bore 32 of the base 11 previously described to be supported at both ends. When effecting this operation, the balance weight portion 43 is used to adjust so that the ear axial line (the central axis of swing) CL extending between the two ear-like portions 46 crosses the center of gravity of the latch 33. By letting the ear axial line CL of the latch 33 go through the center of gravity, the latch 33 is less likely to be adversely affected even if a shock load is applied to the base 11.

Incidentally, the latch 33 supported by the support bore 32 of the base 11 is continuously urged by means of a spring force toward the lock position by the double torsional coiled spring 34 that acts as the spring component. The double torsional coiled spring 34, as shown in FIGS. 1, 6, 8A and 8B, is made by processing a piece of stick-like spring material, and includes double torsional portions 47, 47 wound in a coil, a central lock spring portion 48 formed between these double torsional portions in a deeply curved arch such as an gate or a U-shaped member, and cantilevers 49, 49 that protrude in the same direction from both the outer sides of the double torsional portion 47. The free end of each cantilever portion 49 of the double torsional coiled spring 34 is bent outward so as to be positioned for example on the common axis line SL, the bent portions 50 being pivotally supported by a spring receptacles 51 formed in the lower side of the push button 25.

The lock spring portion 48 of the double torsional spring 34 is guided by the spring guide, i.e. latch nail 44, to engage the concave of the latch 33 from the upper side and pushes by means of spring the latch 34 toward the lock position thereof.

Each of the cantilever 49 double torsional spring 34 is pivotally held at the free end 50 by corresponding spring receptable 51 of the push button 25 so as to press the push button 25 upward to the original, i.e. return, position. In each spring receptacle 51 of the push button 25, a support bore for example through which the double torsional coiled spring 34 is inserted is formed, and a free end of the coiled spring 34 thrusts into this support bore to be supported.

As shown in FIGS. 1, 6, gA and 9B, the push button 25 is constituted by a resin material (a metal material is also acceptable), and a thicker portion is formed transversely at the front end for reinforcing the same. On each of the sides of the front end of the push button 25, one of paired ear-like shafts 53 that protrudes sideward is integrally formed and the ear-like shafts 53, as shown in FIG. 2, pivotally engage a pair of engaging grooves 54 formed in the front end of each base side plate 13. The ear-like shafts 53 may be formed of a material different from the push button 25 such as a metal material to achieve a reinforced structure and, in such a case, the ear-like shafts 53 may be incorporatedly formed by tightly fitting the same into both the sides of the front end portion of the push button 25.

A part of the circumferential portion of the ear-like shaft 53 is cut away, and the presence of this cut-away portion facilitates the attachment and engagement of the ear-like shaft 53 to and with the engaging grooves 54 of the side plates 13 of the base 11. The ear-like shaft 53 of the push button 25 can be smoothly inserted into the engaging grooves 54 for the presence of the cut-away portion thereof and, after the insertion the push button 25 is rotated about the ear-like shaft 53 to thereby be firmly engaged with the engaging grooves 54, thus establishing the secure engagement therebetween.

Each engaging groove 54 has a downward aperture extending obliquely forward and the attachment and removal of the push button 25 are effected through this aperture. The push button 25 retained by the engaging grooves 54 is supported and guided on the inwardly protruding support projections 55, and thus the strength of push button 25 is reinforced. These inwardly protruding support projections 55 are located opposite to one another in the lower part adjacent to the engaging grooves 54 and may be formed by inwardly bending the protruding portions on the front end of the base. Each of the support projections 55 is formed to have an upper surface as a supporting surface to support the ear-like shaft 53 and a lower surface as a guiding surface to guide the insertion of the tongue 14 as will be explained later.

Since, the push button 25 is directly supported by the ear-like shafts 53 in the engaging grooves 54 in the front of the two side plate portions 13, the support structure for supporting the push button 25 is made compact.

On the belly portion of the push button 25 facing the base portion, a pair of engaging projections 56 one on each side are integrally formed in a projecting manner. These engaging projections 56 may engage the front end portion (balance weight portion) of the latch 33, so that, when the push button 25 is pushed downward, the projections 56 push the balance weight portion 43 of the latch 33 to carry the latch 33 to the releasing position against the spring force of the double torsional coiled spring 34.

Furthermore, on each side of the push button 25, a side projection 57 is integrally provided in an outwardly projecting manner and the side projection 57 engageably faces one of inward projections 58 is integrally formed on the inside top of the side plate portion 13 of the base 11. A stopper structure 59 is formed by the inward projection 58 and the side projection 57 of the push button 25, and accordingly, the withdrawal of the push button 25 from the buckle body 10 may be prevented by means of this stopper structure 59, while the original position of the push button 25 is restricted.

Incidentally, a guide path 60 is formed between the horizontal plate portion 12 of said base 11 and the latch 33 and the guiding inward support projection 55 for guiding the insertion of the tongue 14, whereby putting in and out of the tongue 14 from the tongue ingress of the buckle is effected through said guide path 60. The tongue ingress is defined by the assembling of the under cover 20 and the upper cover 24.

As shown in FIG. 1, the tongue 14 includes a latch engaging bore 62 capable of engaging the latch 33 and a webbing attaching bore 63 for attaching the webbing of the seat belt. By carrying the tongue 14 from the front closer to the buckle body 10 and thus by inserting the tongue 14 from the tongue ingress into the guide path 60, the inserting end of the tongue 14 presses the slider 36 of the push out structure 16 against the spring force of the spring 37. If the tongue 14 is inserted further in this condition, the tongue 14 engages the latch engaging bore 62 as a result of force acting thereon by the double torsional coiled spring 34. Hence, the tongue 14 is locked in a full latch engagement, and the withdrawal of the tongue 14 can be prevented.

The main buckle body 10 is covered with the covers 20 and 24 after being integrated into an assembly. The covers 20 and 24 are composed as shown in FIGS. 1, 3 and 4.

Referring to FIG. 10, the operation of the push button type seat belt buckle is now described.

Figure 10A:
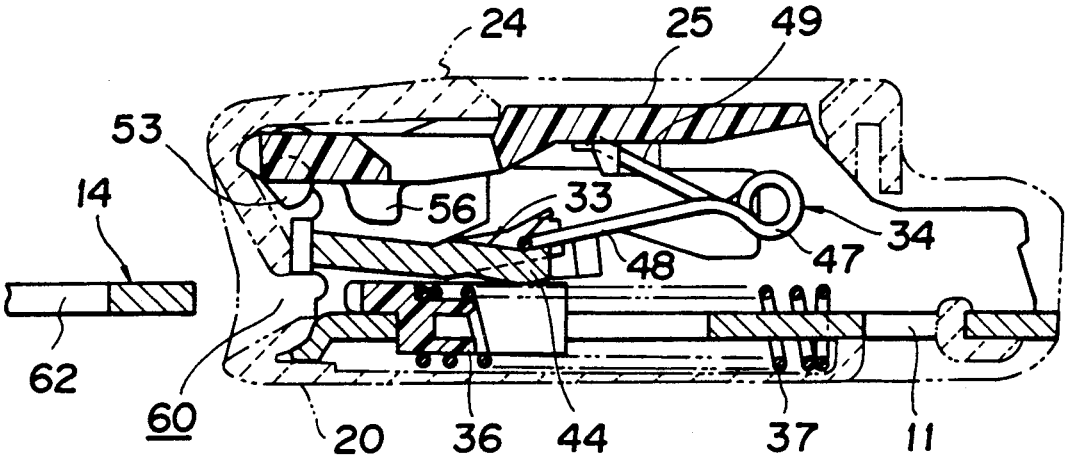
FIGS. 10A, 10B and 10C are cross sections to explain the operation of the seat belt buckle assembly according to this invention.

Before inserting the tongue 14 into the main buckle body 10, the buckle is maintained as shown in FIG. 10A. The push button 25 is retained at the original position side by the spring force of the double torsional coiled spring 34, and the retained push button 25 is maintained at the original position by the stopper structure 59. On the other hand, the latch 33 is steadily spring urged toward the lock position by the spring action of the lock spring portion 48 of the double torsional coiled spring 34 and is retained in that position.

Following the condition shown in FIG. 10A, if the tongue 14 is inserted from the tongue ingress into the main buckle body 10 along the guide path 60, the inserting tip of the tongue 14 first engages the latch 33 and then pushes upward the latch 33 to the releasing position against the spring force rendered by the lock spring portion 48 of the double torsional coiled spring 34, thus making possible a further insertion of the tongue 14.

Figure 10B:
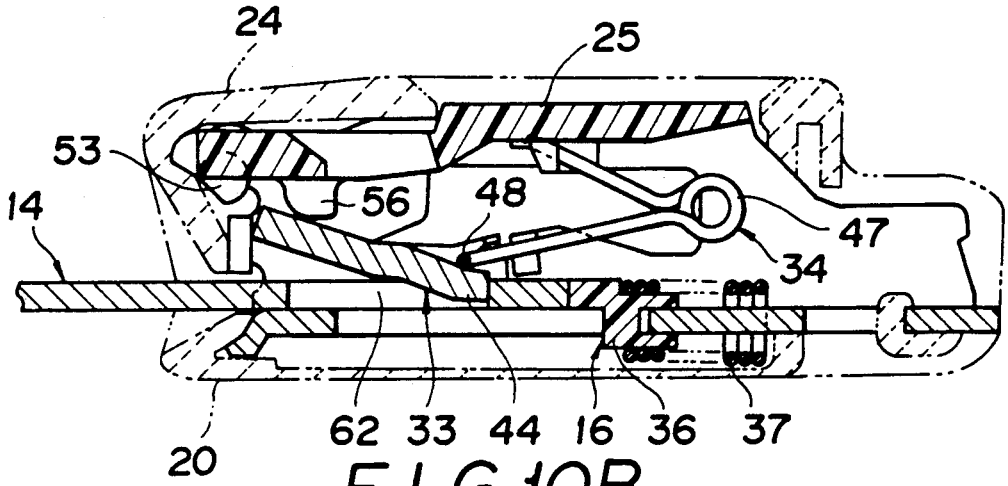

The tongue 14, from this condition, further pushes in the slider 36 of the push out structure 16 against the spring force of the spring 37 and, when the latch engaging bore 62 is inserted as far as the position corresponding to the latch nail 44 of the latch 33, the latch 33 will be pushed and carried toward the locking position by means of the spring force of the lock spring portion 48 of the double torsional coiled spring 34, and as shown in FIG. 10B, the latch nail 44 of the latch 33 will engage the latch engaging bore 60 to releasably lock the tongue 14. Hence the tongue 14 is completely put into a latch engagement, and the coming out thereof may fully and positively prevented.

Since, also, the latch 33 is continuously urged by means of a spring force toward the locking position by the double torsional coiled spring 34 when inserting the tongue 14 into the main buckle body 10, the tongue 14 is positively locked by inserting the tongue 14 only to a predetermined extent, and thus a false latch engagement may be fully and beforehand prevented. The spring force of the double torsional coiled spring 34 may be easily adjusted by changing the diameter thereof, the length of the centrally located locking spring portion 48, as well as the length of the cantilever 49.

Figure 11A:
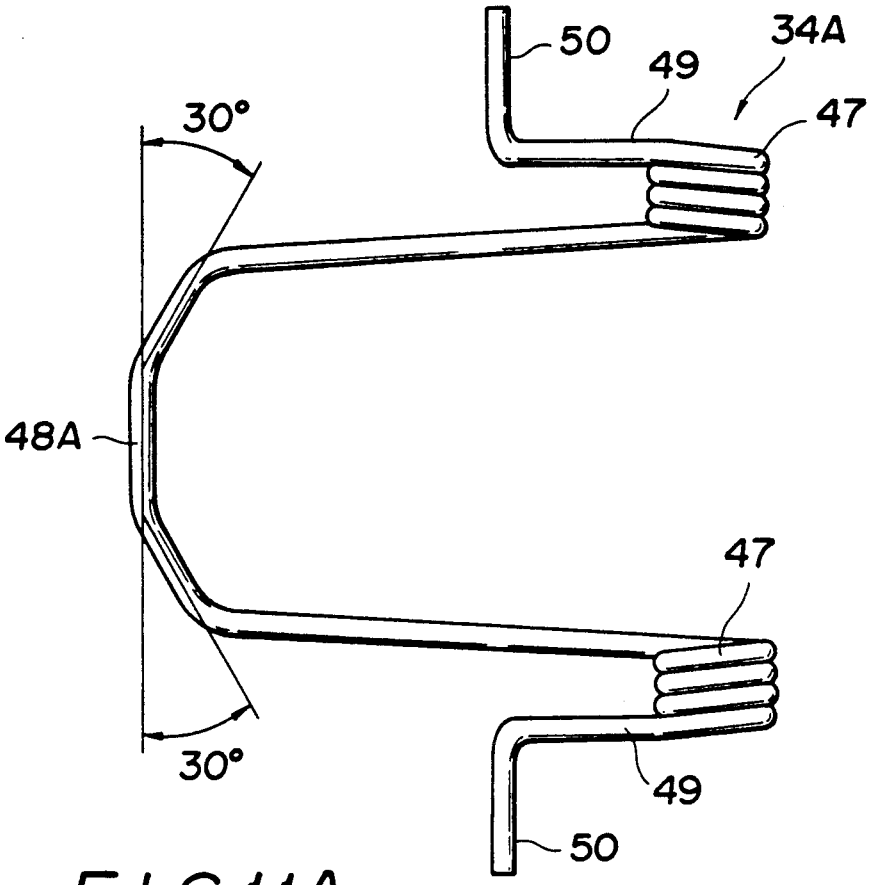
FIGS. 11A and 11B are plan and side views showing a modified double torsional spring to be incorporated into the buckle assembly according to this invention.
Figure 11B:
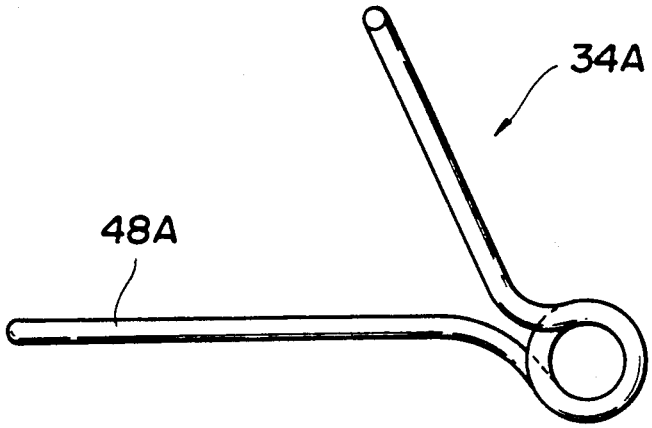

For example, as shown in FIGS. 11A and 11B, one 34A of the double tortional coiled springs 34 may be formed so as to have a central lock spring portion 48A into an angled shape in a plan view.

Figure 10C:
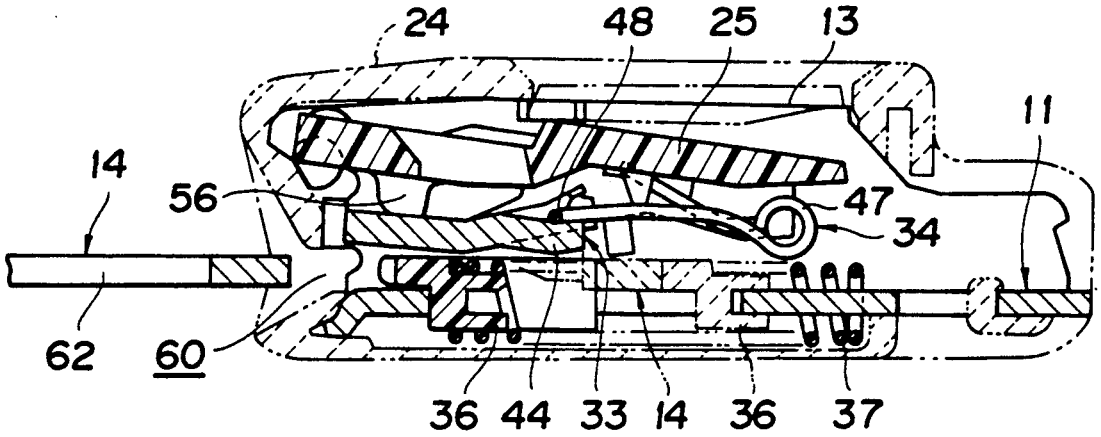

When pulling out the tongue 14 from the locked condition (a full latch engagement) of the tongue 14 as shown in FIG. 10B, the push button 25 is pressed downward against the spring force of the double torsional coiled spring 34. By this downward pressing of the push button 25, the push button pivots around the ear-like shafts 53, whereby the engaging projections 56 of the push button 25 press down the balance weight portion 43 of the latch 33 with an intensified force using leverage, and the latch 33 is thus pivoted toward the releasing position as shown in FIG. 10C against the spring force rendered by the lock spring portion 48.

In response to this pivoting movement, of the latch 33, the engagement between the latch nail 44 of the latch 33 and the latch engaging bore 62 of the tongue 14 is removed and hence, the tongue 14 is released. At this moment, the tongue 14 is pushed out by the spring action of the spring 37 in the push out structure 16, so that the tongue 14 may be easily pulled out from the main buckle body 10.

Since, in this case, the latch 33 is supported by the supporting bores 32 on the side plate portions 13 of the base 11 in a manner that the central axis line of swinging, CL, crosses the center of gravity of the latch 33, even if the base body 10 is acted upon by a large shock load, the latch 33, in spite of this shock load, does not by itself pivot toward the locking position, and thus is not adversely affected by the shock load.

A modification of this invention will now be described hereunder with reference to FIGS. 11 to 13.

The seat belt buckle indicated by this modification comprises an improved tongue that may be inserted and interlocked into the main buckle body 10.

Generally, when a tongue is inserted and interlocked in the main buckle body 10, the tongue jolts in the guide path 62 while causing a striking and/or contacting sound because of a gap existing between the inserted tongue and the tongue ingress of the buckle or the guide path 62, and thus produced sounds have been the cause of a noise.

To prevent in advance the occurrence of noise caused by jolting, a resilient resin component 66 such as of rubber is mounted in an integrated manner to the tongue 65. The resilient component 66 has a cross section as shown in FIG. 13, while the tongue 65 is formed into a curved shape to have a convex portion toward the inserting end thereof. A curved portion 66*a* is inseparably bound to the tongue 65 at the both side side thereof, and the central portion thereof is freed from the tongue surface to provide the curved portion 66*a* with a resilient function.

By providing this resilient component 66 on the tongue 65, when the tongue is inserted into the main buckle body 10, the resilient component 66 resiliently touches the tongue ingress between the under cover 20 and the upper cover 24 that together form a guide path, to prevent the jolting of the tongue 65.

Figure 12:
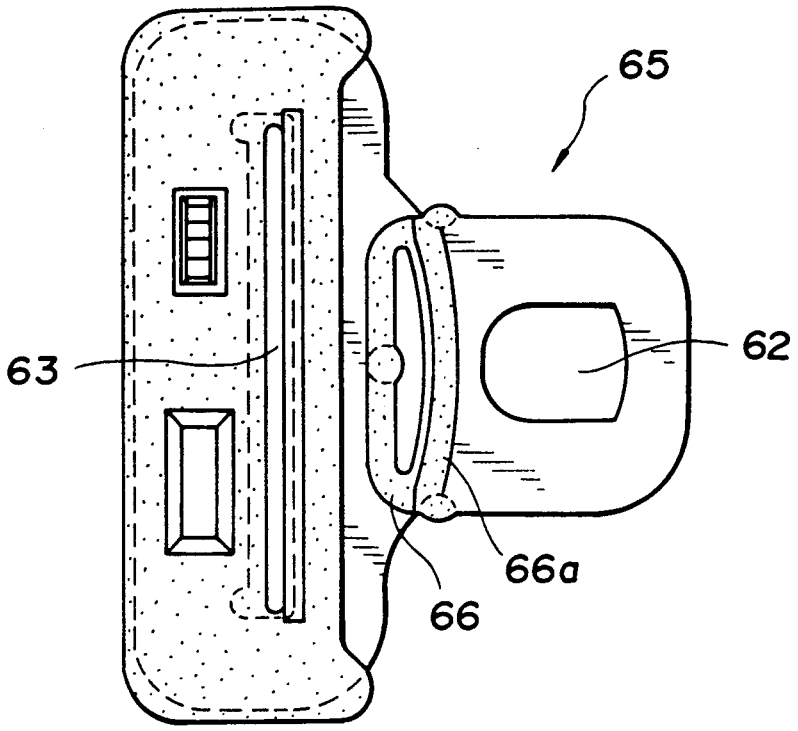
FIGS. 12 and 13 show plan and sectional views representing a variation of the tongue which may be incorporated into the buckle assembly according to this invention.
Figure 13:
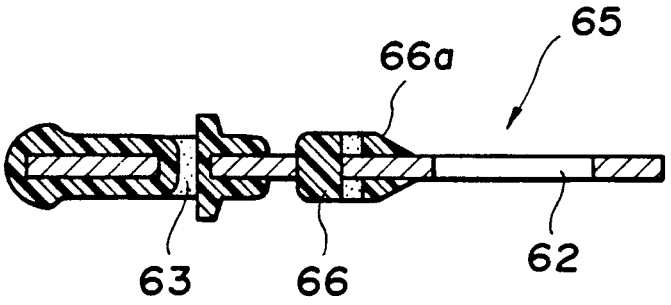

Although, in FIGS. 12 and 13, the resilient component 66 that is integrated into the tongue 65 is shown as an example in which it is formed into a curved convex on the inserting end of the tongue 65, various types of other shapes may be employed. The resilient component is only required to be capable of elastic deformation, when the tongue is inserted into the main buckle body, at least to prevent the jolting of the tongue, and is not limited to have any specific shape.

What is claimed is:

1. A buckle assembly for a seat belt comprising:

a base having a horizontal plate and side plates formed integrally with both longitudinal side portions of said horizontal plate and extending substantially normal thereto;

latch means engageable with said side plates and supported thereby so as to be swingable between a latch locking position and a latch releasing position;

a push button pivotally mounted on said side plates of the base;

spring means engageable with said latch means for always urging said latch means towards the locking position thereof, said spring means having a double torsional spring structure comprising double torsional portions, a central lock spring portion formed between said double torsional portions and engageable with said latch means to urge said latch means to the locking position thereof, and cantilever portions formed outside said double torsional portions and carried by said push button so as to urge said push button towards an original position thereof;

tongue means insertable into a tongue insertion space formed between said horizontal plate and said side plates of the base and releasably engageable with said latch means;

a lower cover for covering said base from a lower side thereof; and an upper cover for covering said base from an upper side thereof and engaged with said lower cover.

2. A seat belt buckle assembly according to claim 1, wherein said side plates are provided with supporting holes; and said latch means has ear-like portions engageable with said supporting holes of the side plates when said latch means is inserted to be swingable between the locking position and releasing position thereof.

3. A seat belt buckle assembly according to claim 1, wherein said push button has at a base end thereof an ear-like shaft which is engageable at both ends thereof with said side plates to be pivotable thereabout.

4. A seat belt buckle assembly according to claim 3, wherein said side plates have at one end portions thereof openings pivotably supporting the end portions of said ear-like shaft of said push button.

5. A seat belt buckle assembly according to claim 3, wherein said ear-like shaft has a circumferential outer surface having a cut-away portion exhibiting a flat surface.

6. A seat belt buckle assembly according to claim 1, wherein said double torsional spring structure has two free end portions engageable in spring receptables formed at both side portions of said push button.

7. A seat belt buckle assembly according to claim 1, wherein said double torsional spring means comprises a bilaterally symmetrical structure and said double torsional portions of said spring means comprise coiled spring elements.

8. A seat belt buckle assembly according to claim 1, wherein said base includes a push out mechanism engageable with a front end of said tongue means, said push out mechanism having means for pushing out said tongue means when said latch means is released by downwardly pressing said push button.

9. A seat belt buckle assembly according to claim 8, wherein said push out mechanism comprises a push out slider and a spring member for forwardly urging said push out slider, said push out slider having a slide groove slidably engaged with a slide guide bore formed in said horizontal plate of the base, a push surface engageable with the front end of said tongue means, and a spring receptable for receiving said spring member.

10. A seat belt buckle assembly according to claim 1, wherein said push button has side portions having projections extending outwardly and said side plates of the base have projections extending inwardly, said outward projections of the push button and said inward projections of the side plates constituting a stopper mechanism for said push button when engaged with each other.

11. A seat belt buckle assembly according to claim 1, wherein said latch means comprises a flat base portion and a balance weight portion integrally formed with said flat base portion so as to exhibit a dog leg shape, said flat base portion having a central portion recessed to constitute a latch nail to be engaged with said spring means and ear-like side portions so that a central line between said ear-like portions defines the axis of swinging motion of the latch means and passes through the center of gravity of said latch means.

12. A seat belt buckle assembly according to claim 11, wherein said flat base portion of the latch means has a guide bellows extending outwardly at substantially a central portion of said latch nail for guiding insertion of said central lock spring portion of said spring means, and a pair of spring guides disposed so as to extend over said latch nail to support the insertion of said lock spring portion of the spring means.

13. A seat belt buckle assembly according to claim 12, wherein said central spring portion of the spring means has an angled shape so as to facilitate the engagement with said latch nail in association with said guide bellows.

14. A seat belt buckle assembly according to claim 11, wherein said push button has engaging projections engageable with said balance weight portion of the latch means so as to swing said latch means towards the lock releasing position against a spring urging force of said double torsional spring means when said push button is pressed downwardly.

15. A seat belt buckle assembly according to claim 1, wherein said tongue means has a resilient member integrally formed thereon for preventing a jolting motion thereof when inserted into said tongue inserting space.

16. A buckle assembly for a seat belt, comprising:

a buckle having a base, two opposed side members upstanding from opposite sides of the base, a latch member swingably mounted on the two side members and swingable upwardly to a releasing position and downwardly from the releasing position, the latch member coacting with the base and two side members to define a tongue insertion space, a depressible push button pivotally mounted on the two side members and pivotal upwardly to a raised position and downwardly to a depressed position, the push button having means for engaging with the latch member as the push button pivots downwardly to its depressed position to effect upward swinging of the latch member to its releasing position, and a torsion spring interposed between the push button and the latch member for resiliently biasing the push button upwardly to its raised position and resiliently biasing the latch member downwardly, the torsion spring having a central portion engageable with the latch member, two helical torsional portions respectively connected to opposite sides of the central portion, and two end portions respectively connected to the two helical torsional portions and terminating in free ends carried by the push button; and a tongue insertable into the tongue insertion space of the buckle beneath the latch member, the tongue having an opening for receiving therein the latch member so that when the tongue is inserted a predetermined distance into the tongue insertion space the torsion spring biases the latch member downwardly into the tongue opening to thereby releasably lock the tongue, whereby subsequent depression of the push button against the upward resilient bias of the torsion spring swings the latch member upwardly out of the tongue opening to permit withdrawal of the tongue out of the tongue insertion space.

17. A buckle assembly according to claim 16; wherein the latch member is mounted on the two side members to undergo swinging movement about an axis that extends through the center of gravity of the latch member.

18. A buckle assembly according to claim 17, wherein the latch member has a downwardly concave portion configured to receive therein the central portion of the torsion spring.

19. A buckle assembly according to claim 18, wherein the latch member has a pair of spring guides, one on either side of the concave portion, for guiding therebetween the central portion of the torsion spring.

20. A buckle assembly according to claim 16, including a slider mounted to undergo forward and rearward sliding movement on the base between a forward position in which the slider is positioned beneath the latch member so as to block the entrance to the tongue insertion space and a rearward position in which the slider is positioned rearwardly of the tongue insertion space, and spring means for urging the slider toward the forward position, whereby insertion of the tongue into the tongue insertion space effects rearward sliding movement of the slider against the force exerted by the spring means to enable the tongue to be releasably locked by the latch member and depression of the push button releases the locking engagement of the latch member to permit the spring means to effect forward sliding movement of the slider to push the tongue out of the tongue insertion space.

21. A buckle assembly according to claim 16, wherein the tongue has a coating of elastically deformable material to prevent free play between the tongue and buckle during insertion and withdrawal of the tongue.

22. A buckle assembly according to claim 21, wherein the elastically deformable material comprises a resin.

* * * * *